US009498060B1

(12) United States Patent
Hsu

(10) Patent No.: US 9,498,060 B1
(45) Date of Patent: Nov. 22, 2016

(54) SLIDE TRACK ASSEMBLY

(71) Applicant: Chi-Feng Hsu, New Taipei (TW)

(72) Inventor: Chi-Feng Hsu, New Taipei (TW)

( * ) Notice: Subject to any disclaimer, the term of this patent is extended or adjusted under 35 U.S.C. 154(b) by 0 days.

(21) Appl. No.: 14/735,193

(22) Filed: Jun. 10, 2015

(51) Int. Cl.
*A47B 88/04* (2006.01)
*A47B 88/08* (2006.01)
*A47B 88/16* (2006.01)

(52) U.S. Cl.
CPC ..... *A47B 88/08* (2013.01); *A47B 88/047* (2013.01); *A47B 88/16* (2013.01)

(58) Field of Classification Search
CPC .... A47B 88/08; A47B 88/04; A47B 88/047; A47B 88/0477; A47B 88/0481
See application file for complete search history.

(56) References Cited

U.S. PATENT DOCUMENTS

2005/0184629 A1* 8/2005 Yang ..... A47B 88/047 312/334.4
2007/0090735 A1* 4/2007 Hashemi ..... A47B 88/0477 312/334.46
2008/0169741 A1* 7/2008 Jurja ..... A47B 88/0477 312/319.1
2008/0197754 A1* 8/2008 Roux ..... B06B 1/0622 310/334
2012/0062088 A1* 3/2012 Chen ..... A47B 88/0477 312/319.1
2013/0004101 A1* 1/2013 Chen ..... A47B 88/0477 384/10
2015/0366345 A1* 12/2015 Chen ..... A47B 88/047 312/319.1
2016/0060934 A1* 3/2016 Chen ..... A47B 88/12 16/96 R

* cited by examiner

*Primary Examiner* — Daniel Rohrhoff
(74) *Attorney, Agent, or Firm* — Alan D. Kamrath; Kamrath IP Lawfirm, P.A.

(57) ABSTRACT

A slide track assembly includes an outer track having a first unlocking face, a first stop face, and a second stop face. A middle track is slideably received in the outer track and includes a sliding groove. An inner track is slideably received in the middle track and includes a first unlocking portion, a first stop portion, and a second stop portion. A positioning block is received in the sliding groove and is slideable relative to the middle track in a vertical direction. The positioning block includes first and second stop ends. The positioning block further includes a stop face extending between the first and second stop ends and facing the first lateral wall of the sliding groove. The positioning block can be moved to lock or unlock the inner track, the middle track, and the outer track during extending and retraction of the inner track and the middle track.

6 Claims, 17 Drawing Sheets

SLIDE TRACK ASSEMBLY

BACKGROUND OF THE INVENTION

The present invention relates to a slide track assembly and, more particularly, to a three-part type slide track assembly permitting stable sequential retraction and extension.

A conventional three-part type slide track assembly includes an outer track, a middle track, and an inner track. In an example of a three-part type slide track assembly for a cabinet type server, the outer track is mounted to a frame, the inner track is fixed to a side of the server, and the middle track serves as a loading track and is mounted between the outer track and the inner track, permitting the server to move in a range. Furthermore, the inner track and the middle track can slide relative to the outer track to permit the server to be pulled outwards or pushed inwards.

In a conventional three-part type slide track assembly, the middle track includes a sliding groove receiving a movable cylindrical positioning peg. Each of the outer track and the inner track includes a locking plate. The cylindrical positioning peg includes a plurality of cylindrical sections having different diameters to cooperate with the sliding groove and the locking plates for controlling locking and unlocking of the inner track, the middle track, and the outer track, permitting sequential extension and retraction of the inner track and the middle track relative to the outer track. However, the cooperation between the cylindrical positioning peg having the cylindrical sections of different diameters, the sliding grooves, and the locking plates are unstable, and the structural strength is adversely affected.

Thus, a need exists for a novel three-part type slide track assembly permitting stable sequential retraction and extension.

BRIEF SUMMARY OF THE INVENTION

The primary objective of the present invention is to provide a slide track assembly to permit the middle track and the inner track to be sequentially pulled outwards or to be sequentially pushed inwards in a smooth manner relative to the outer track while enhancing the structural strength and the durability of the slide track assembly as well as permitting easy manufacturing and easy assemblage.

A slide track assembly according to the present invention includes an outer track having a first projection. The first projection includes a first unlocking face, a first stop face, and a second stop face. The first stop face is located between the first unlocking face and the second stop face in a longitudinal direction. A middle track is slideably received in the outer track. The middle track is slideable relative to the outer track in the longitudinal direction. The middle track includes a sliding groove having first and second lateral walls spaced from each other in the longitudinal direction. An inner track is slideably received in the middle track. The inner track is slideable relative to the middle track in the longitudinal direction. The inner track includes a second projection. The second projection includes a first unlocking portion, a first stop portion, and a second stop portion. The first stop portion is located between the first unlocking portion and the second stop portion in the longitudinal direction. A positioning block is slideably received in the sliding groove. The positioning block is slideable relative to the middle track in a vertical direction perpendicular to the longitudinal direction. The positioning block includes a first stop end and a second stop end opposite to the first stop end. The second stop end is spaced from the first stop end in a thickness direction perpendicular to the longitudinal and vertical directions. The positioning block further includes a stop face extending between the first stop end and the second stop end, extending perpendicular to the longitudinal direction, and facing the first lateral wall of the sliding groove. The positioning block further includes a guiding face facing away from the stop face. A return spring is attached between the positioning block and a wall of the sliding groove. The return spring biases the positioning block towards the first projection or the second projection. The first stop end of the positioning block is positionable between the first stop face and the second stop face to position the middle track relative to the outer tack while permitting movement of the positioning block in the vertical direction and having play in the longitudinal direction.

When the inner track is moved inwards from an extended position relative to the middle track to a retracted position in the middle track, the first unlocking portion of the inner track presses against the guiding face of the second stop end to move the positioning block in the sliding groove of the middle track in the vertical direction until the second stop end is restrained between the first stop portion and the second stop portion of the inner track while permitting movement of the positioning block in the vertical direction. The first stop end of the positioning block is disengaged from the first stop face of the outer track, permitting the middle track and the inner track to move jointly from the fully extended position of the middle track to a retracted position received in the outer track.

When the middle track is in a fully retracted position relative to the outer tack and when the inner track is in a fully retracted position relative to the middle track, the second stop end of the positioning block is restrained between the first stop portion and the second stop portion of the inner track to position the middle track relative to the outer tack while permitting movement of the positioning block in the vertical direction. The stop face and the guiding face of the positioning block are respectively positioned at the first stop portion and the second unlocking portion of the inner track while permitting the positioning block and the second stop portion to move relative to each other. The second unlocking portion of the inner track actuates the positioning block to move in the vertical direction while the positioning block and the second stop portion are moving towards each other to unlock the middle track and the outer track.

When the inner track is pulled outwards from the fully retracted position, the first stop portion of the inner track presses against the second stop end of the positioning block to jointly move the middle track and the inner track out of the outer track. When the positioning block contacts the first projection of the outer track, the first unlocking face of the first projection presses against the guiding face of the first stop end of the positioning block to move the positioning block in the sliding groove of the middle track, disengaging the second stop end of the positioning block from the first stop portion of the inner track to thereby unlock the middle track and the inner track, such that the inner track is permitted to be pulled out of the middle track to the fully extended position.

The outer track can further include a second unlocking face between the first stop face and the second stop face. The second unlocking face is at an acute angle to the vertical direction. The inner track can further include a second unlocking portion between the first stop portion and the second stop portion. The second unlocking portion is at an acute angle to the vertical direction.

A spacing between the first stop face and the second stop face of the outer track in the longitudinal direction being in a range of 1.3-2.3 times a width between the first and second lateral walls of the sliding groove. The positioning block is positionable between the first stop face and the second unlocking face of the outer track while permitting the positioning block and the second stop face of the outer track to move towards each other. The second unlocking face of the outer track actuates the positioning block to move in the vertical direction while the positioning block and the second stop face of the outer track are moving towards each other, unlocking the middle track and the inner track.

A spacing between the first stop portion and the second stop portion of the inner track in the longitudinal direction being in a range of 1.3-2.3 times the width between the first and second lateral walls of the sliding groove. The positioning block is positionable between the first stop portion and the second unlocking portion of the inner track while permitting the positioning block and the second stop portion of the inner track to move towards each other. The second unlocking portion of the inner track actuates the positioning block to move in the vertical direction while the positioning block and the second stop portion of the inner track are moving towards each other, unlocking the middle track and the outer track.

The middle track can include a first side facing the first projection of the outer track and a second side facing the second projection of the inner track. The sliding groove can include rectangular cross sections and can extend from the first side of the inner track through the second side of the inner track. Each of the first and second lateral walls of the sliding groove includes a plurality of recesses. The positioning block further includes a vertical side opposite to the stop face of the positioning block. The vertical side faces the second lateral wall of the sliding groove and intersects with the guiding face. The stop face of the positioning block includes a guiding section opposite to the guiding face. The first stop end of the positioning block includes a first protrusion on each of two sides thereof. The first protrusions respectively extend on the stop face and the vertical face. The second stop end of the positioning block includes a plurality of second protrusions on each of two sides thereof. The second protrusions on one of the two sides of the second stop end of the positioning block extend on the stop face. The second protrusions on the other of the two sides of the second stop end of the positioning block extend on the vertical face. The second protrusions of the positioning block inserted from the first side of the middle track through the recesses of the sliding groove to the second side of the middle track. Each of the first and second lateral walls of the sliding groove located between one of the first protrusions and the second protrusions on one of two sides of the seconds top end of the positioning block while permitting the positioning block to move in the vertical direction and in the longitudinal direction.

The positioning block can include a bottom face extending between the first stop end and the second stop end. The bottom face has a bottom hole. The return spring abuts against an end wall of the bottom hole of the positioning block and a bottom wall of the sliding groove to bias the positioning block upwards.

The present invention will become clearer in light of the following detailed description of illustrative embodiments of this invention described in connection with the drawings.

DETAILED DESCRIPTION OF THE INVENTION

Figure 1:
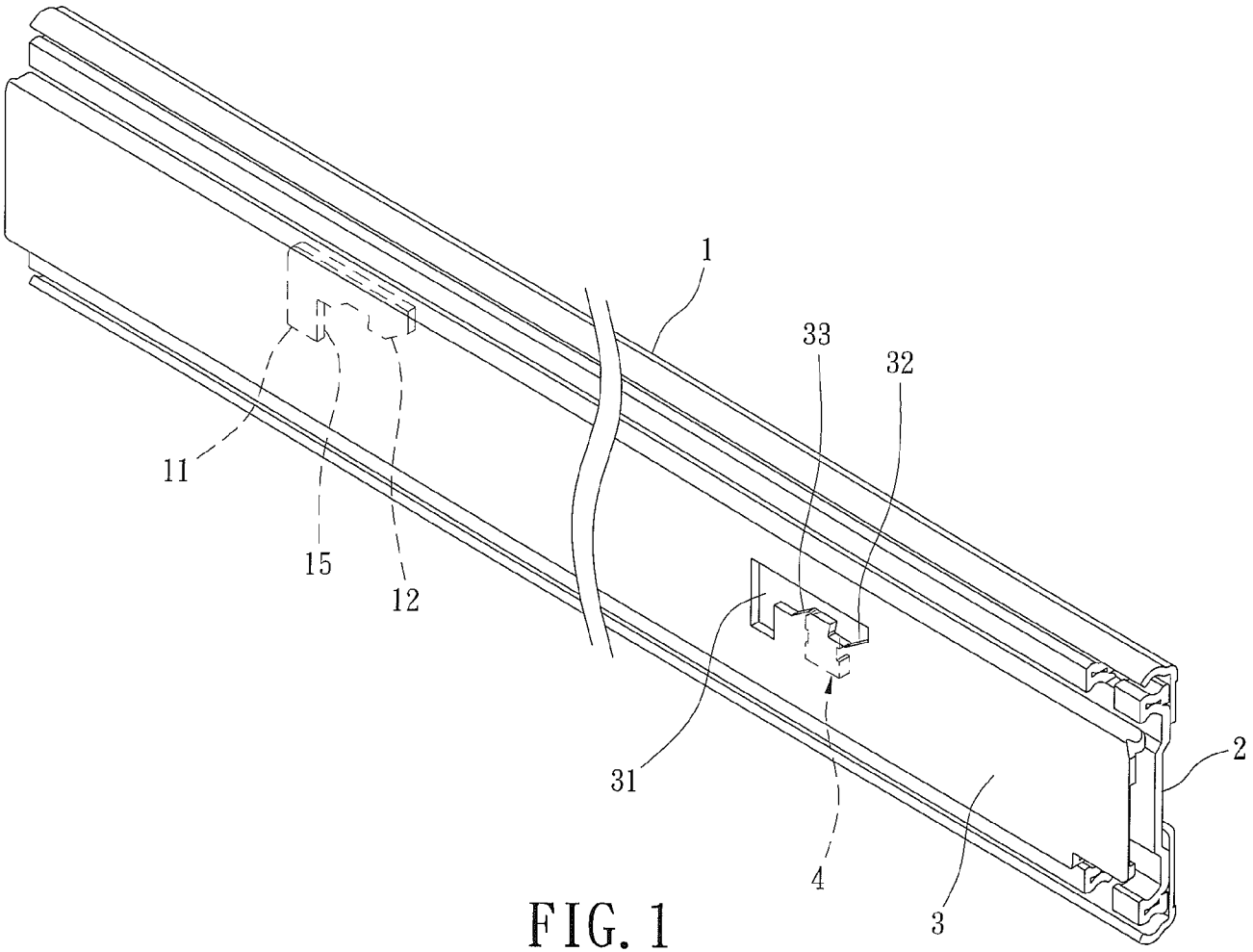
FIG. 1 is a perspective view of a slide track assembly according to the present invention in a fully retracted state.
Figure 2:
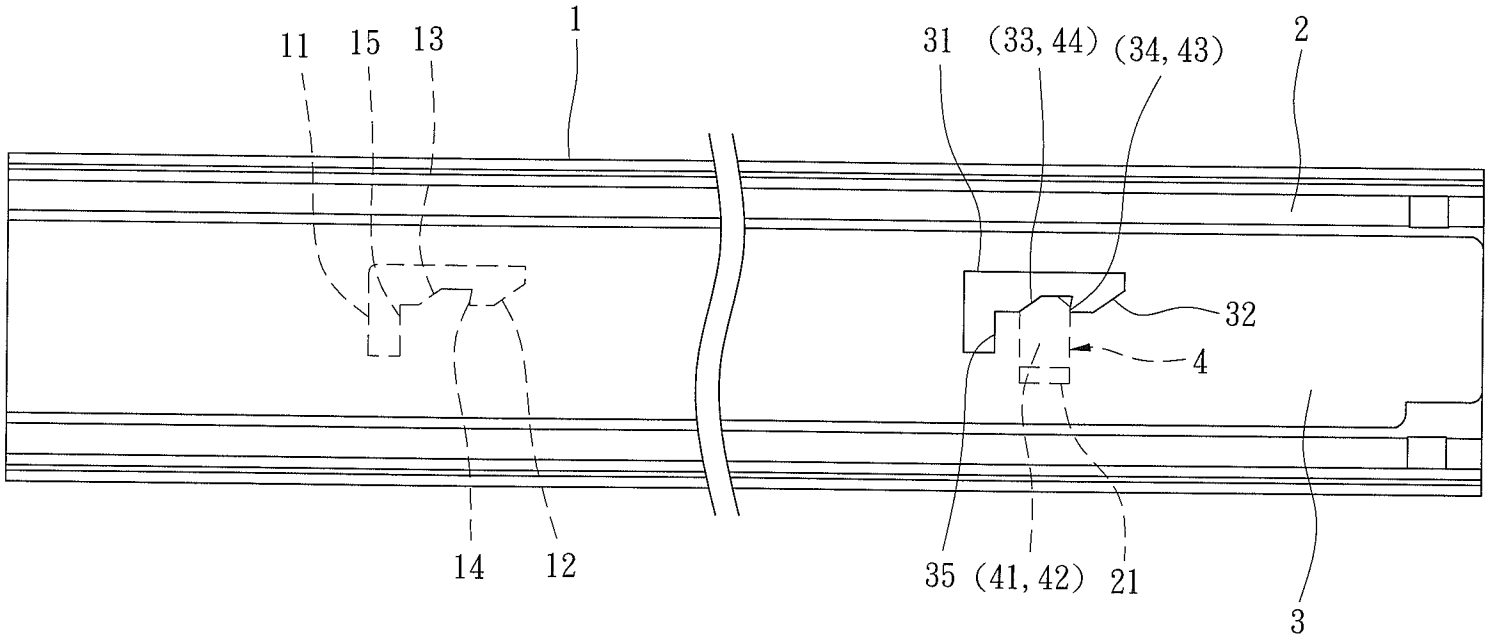
FIG. 2 shows a front view of the slide track assembly of FIG. 1.
Figure 3:
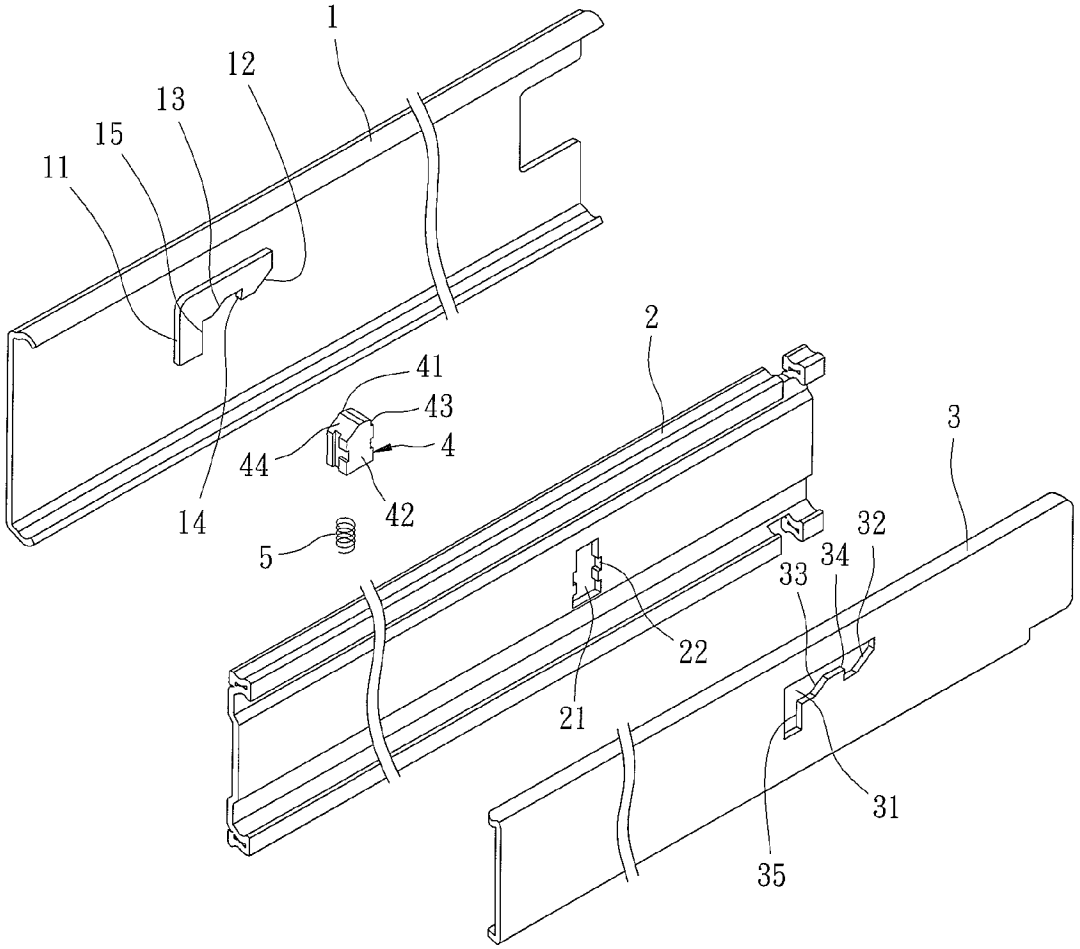
FIG. 3 is an exploded, perspective view of the slide track assembly of FIG. 1.
Figure 4:
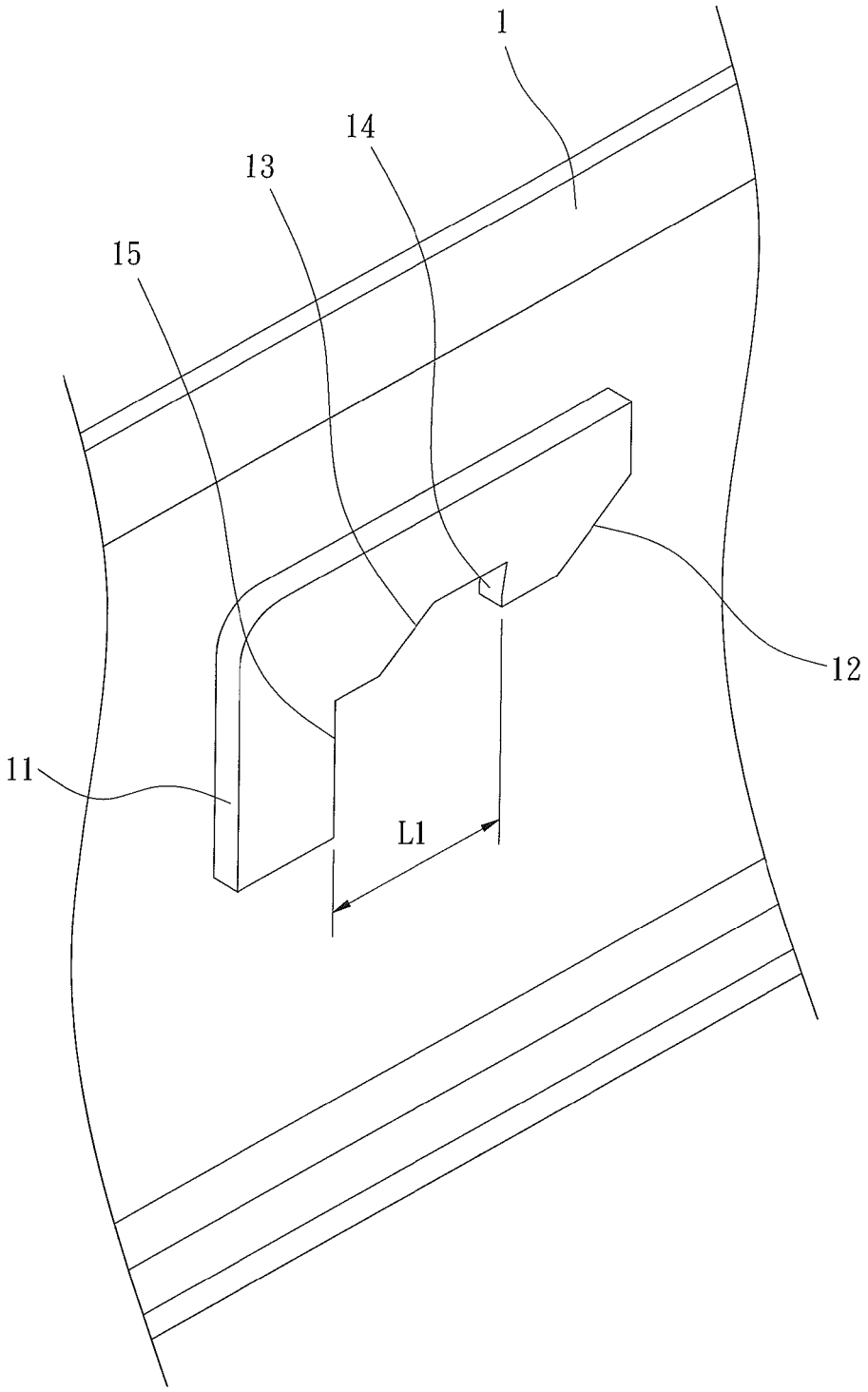
FIG. 4 is a partial, enlarged, perspective view of an outer track of the slide track assembly of FIG. 1, illustrating a first projection on the outer track.
Figure 5:
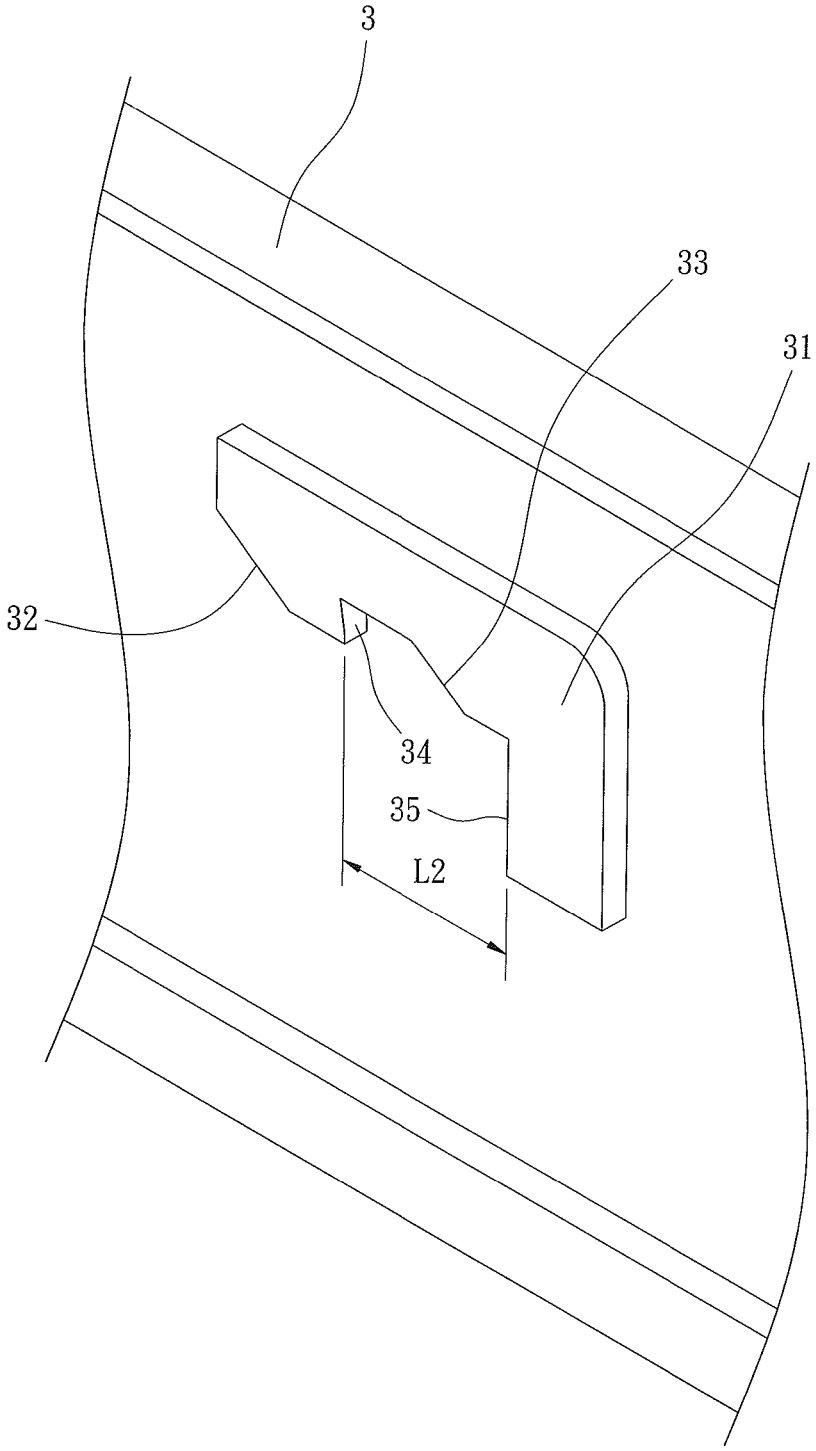
FIG. 5 is a partial, enlarged, perspective view of an inner track of the slide track assembly of FIG. 1, illustrating a second projection on the inner track.
Figure 6:
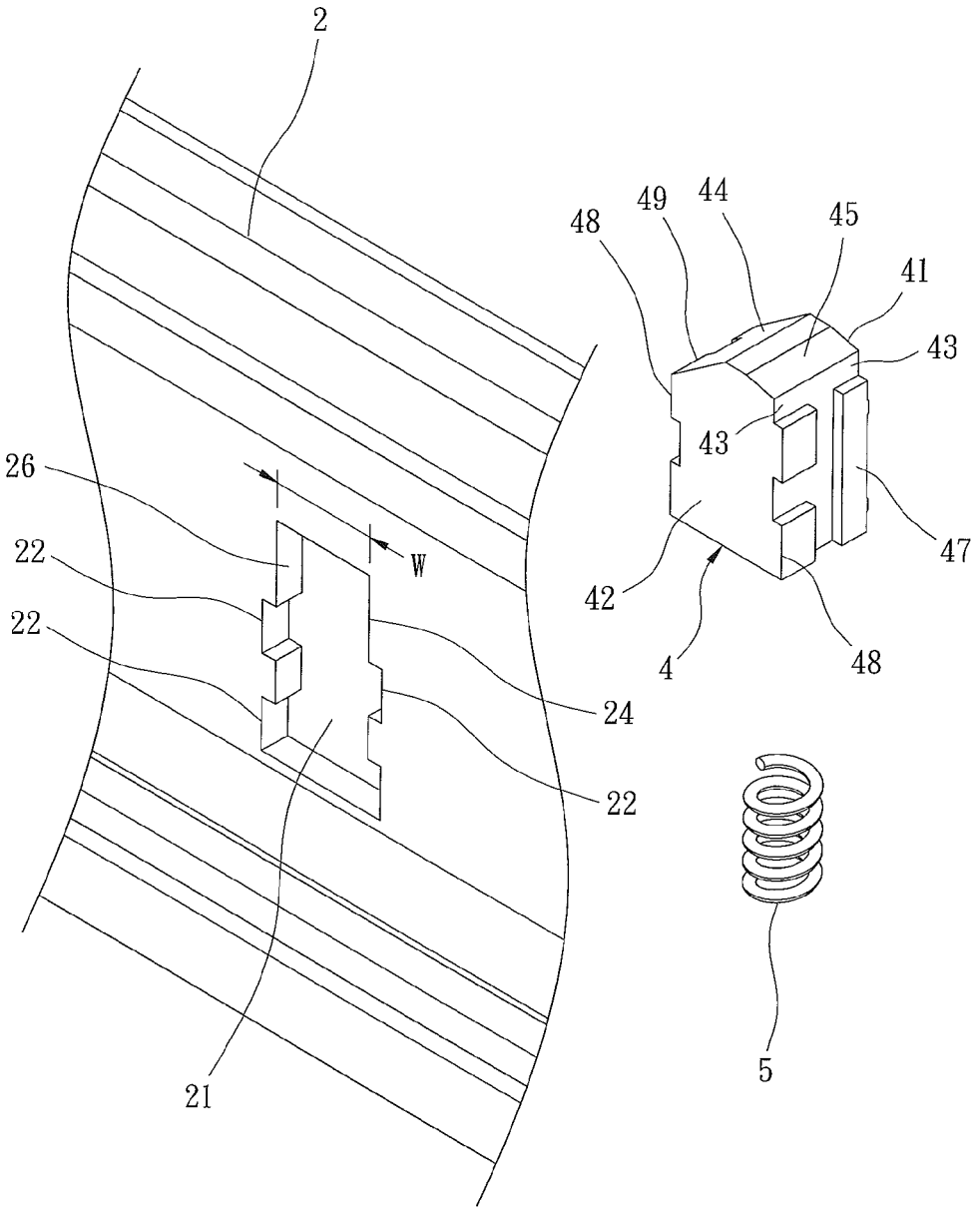
FIG. 6 is a partial, enlarged, exploded, perspective view of a middle track, a positioning block, and a return spring of the slide track assembly of FIG. 1.
Figure 7:
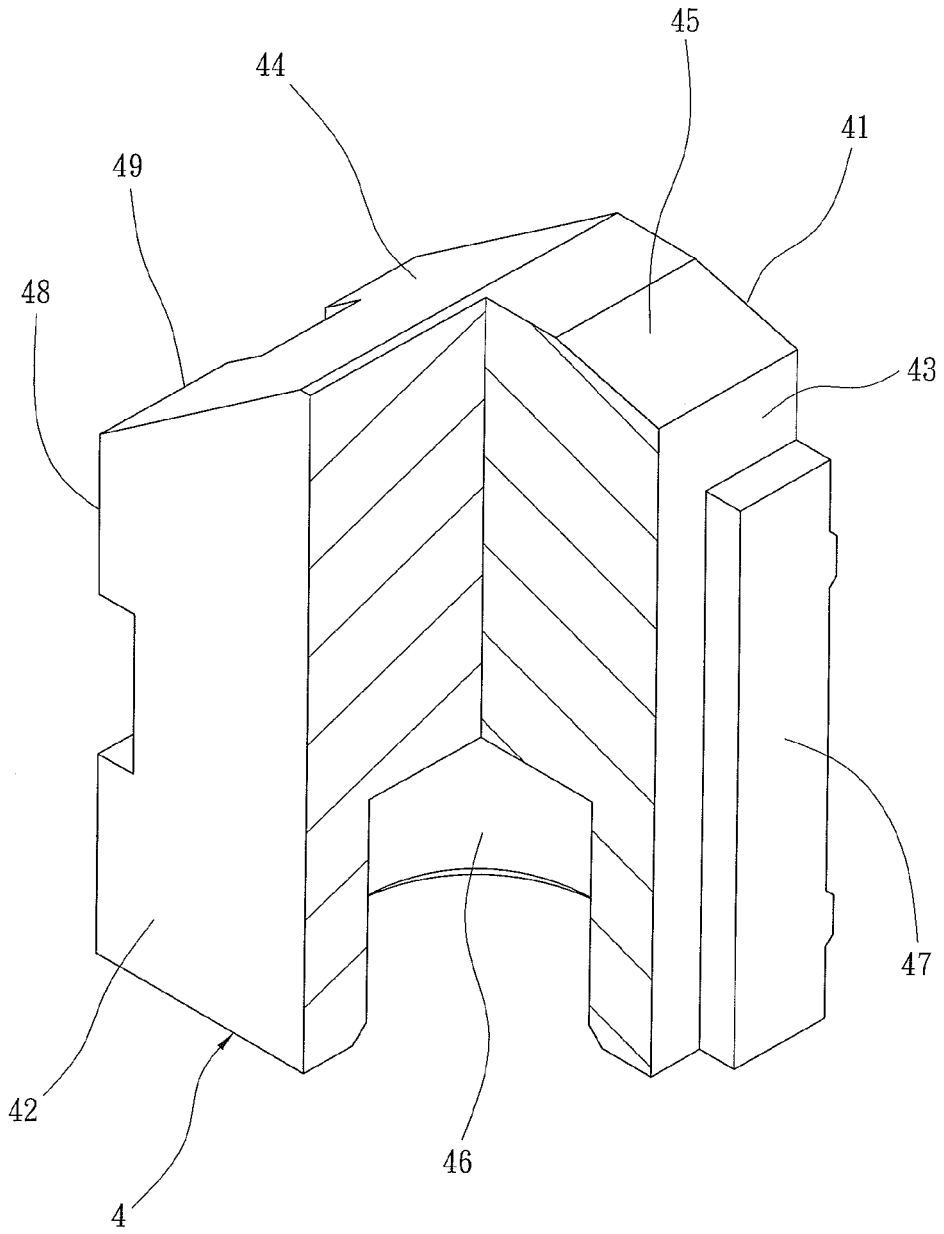
FIG. 7 is a partly-cutaway perspective view of the positioning block of FIG. 6.
Figure 8:
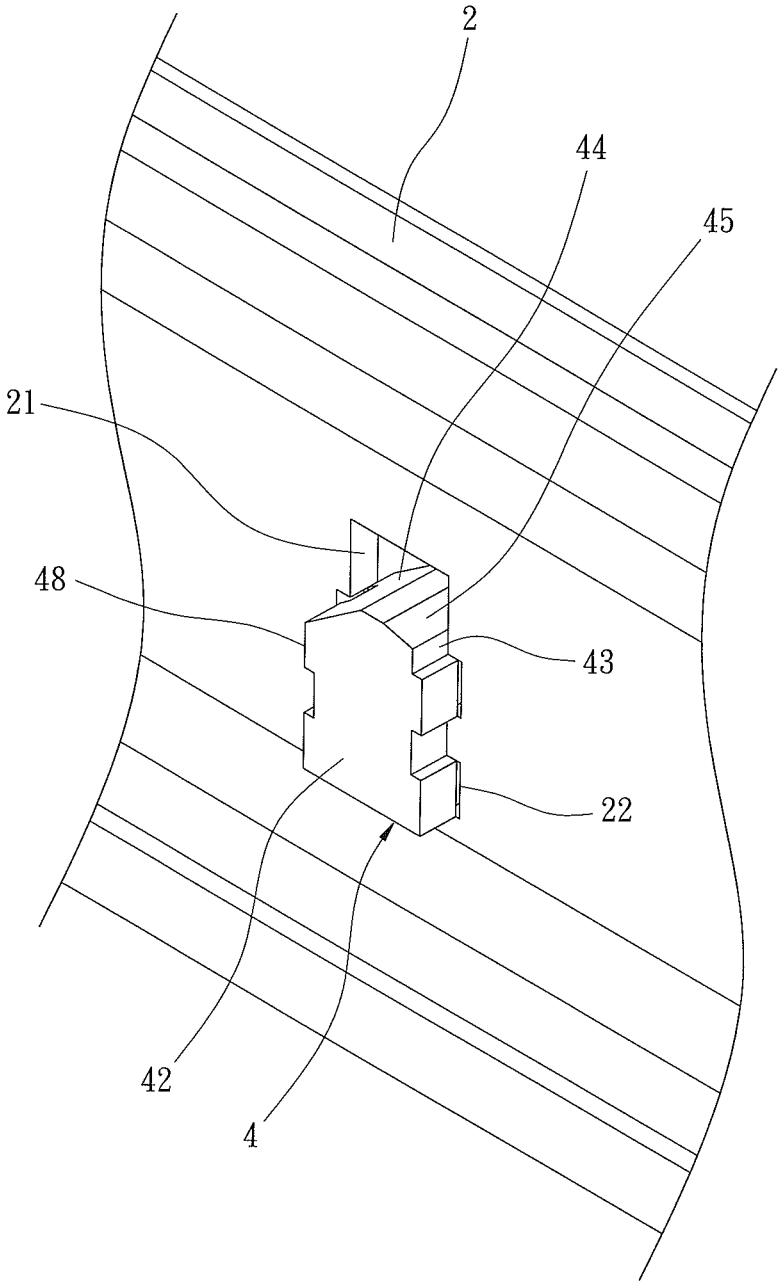
FIG. 8 is a partial, perspective view of the middle track of FIG. 6, with the positioning block mounted in a sliding groove of the positioning block and located in a lower position.
Figure 9:
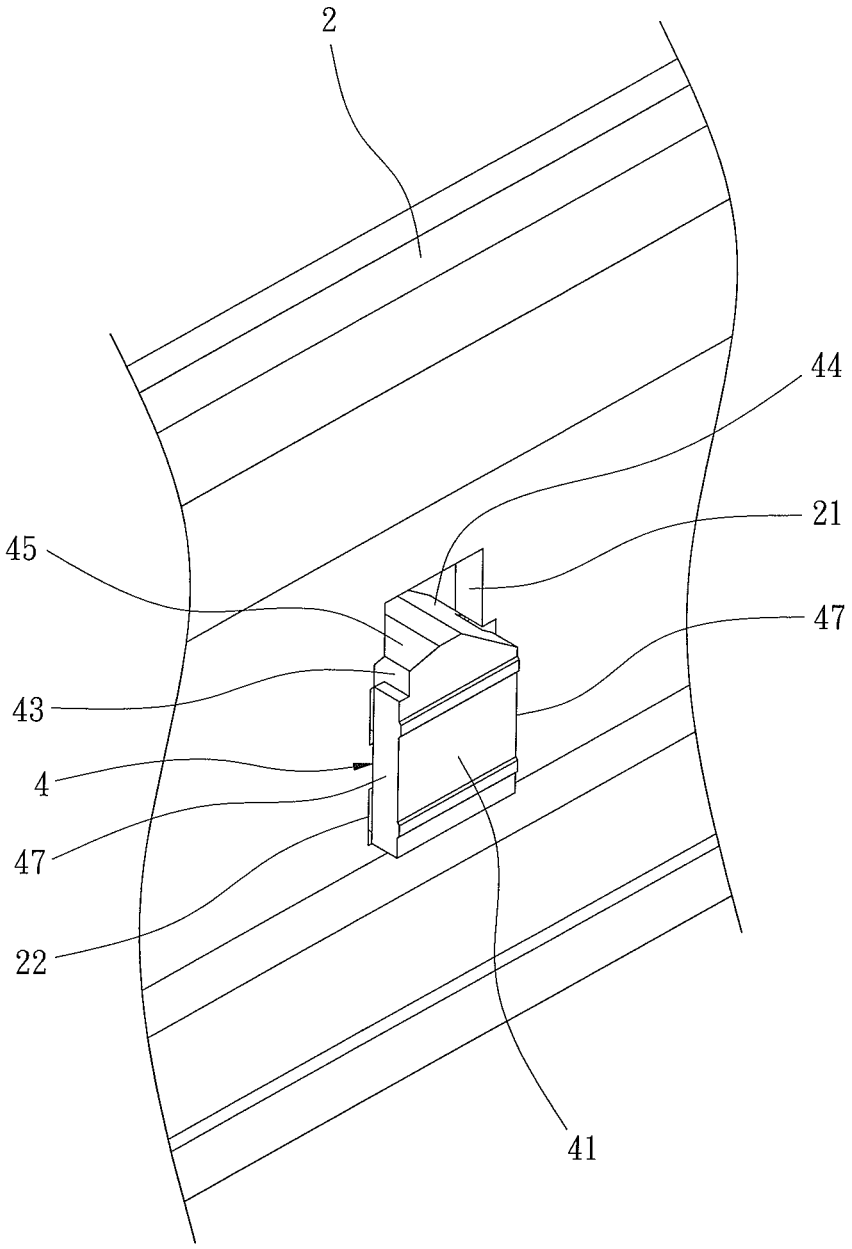
FIG. 9 is another partial, perspective view of the middle track of FIG. 8.
Figure 10:
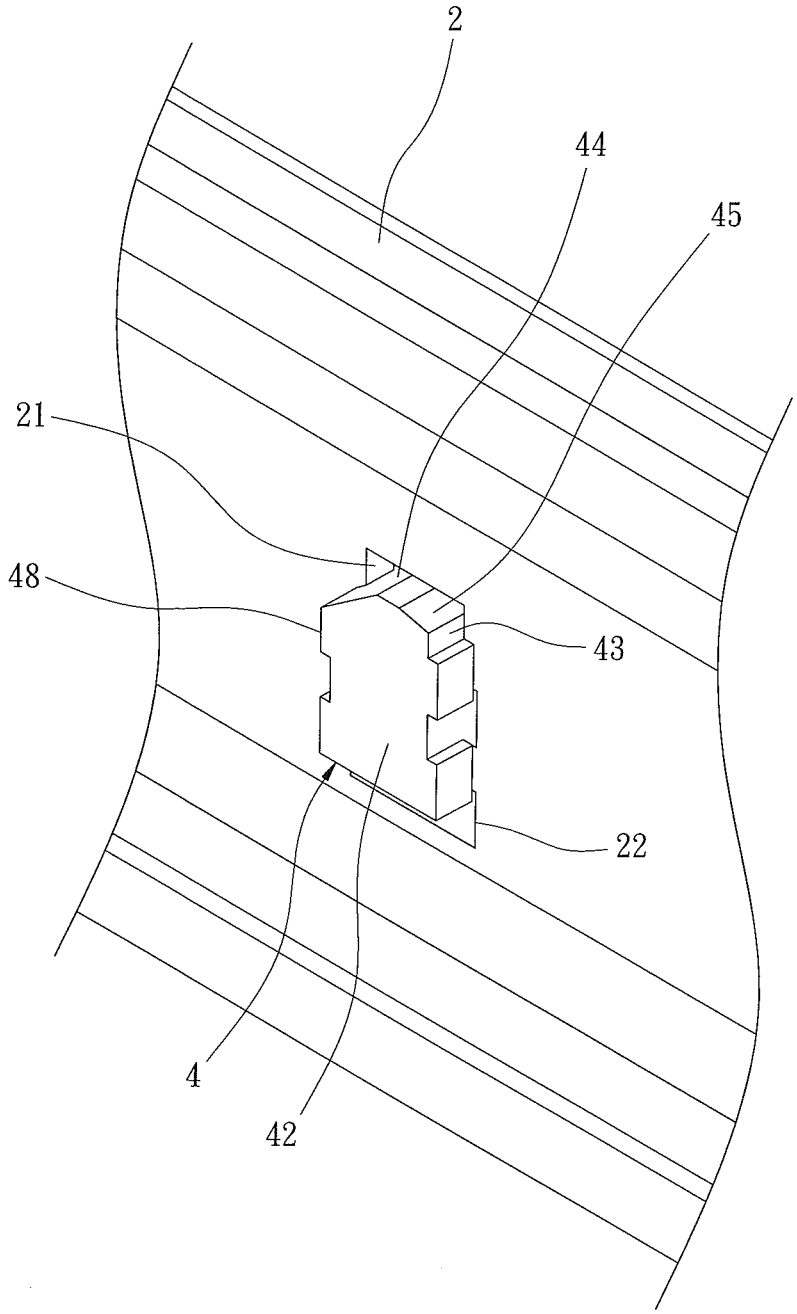
FIG. 10 is a view similar to FIG. 8, with the positioning block moved to an upper position.
Figure 11:
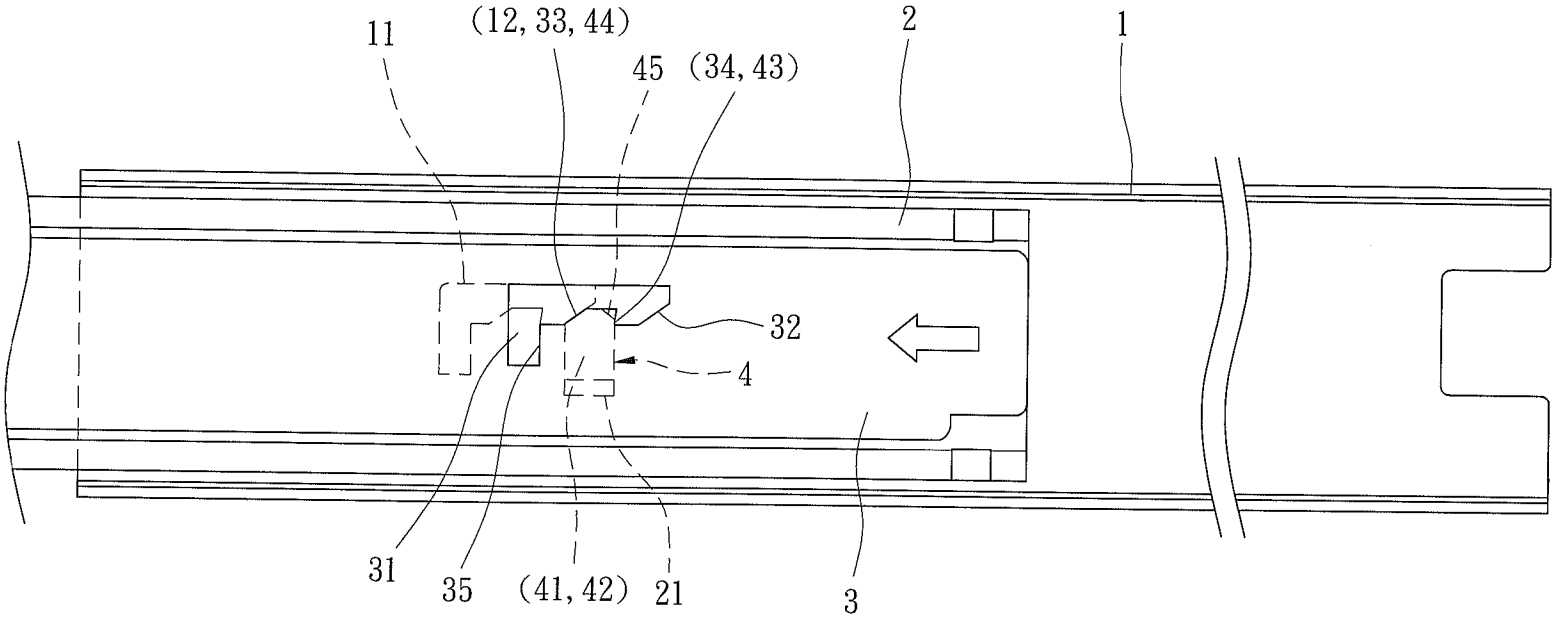
FIG. 11 is a view similar to FIG. 2, illustrating outward movement of the middle track and the inner track from the fully retracted position.

With reference to FIGS. 1-10, a slide track assembly according to the present invention includes an outer track 1, a middle track 2, an inner track 3, a positioning block 4, and a return spring 5.

The outer track 1 is elongated and includes a first projection 11. The first projection 11 includes a first unlocking face 12, a first stop face 14, a second unlocking face 13, and a second stop face 15 arranged in sequence. The first stop face 14 is located between the first unlocking face 12 and the second unlocking face 13 in a longitudinal direction. The second unlocking face 13 is located between the first stop face 14 and the second stop face 15 in the longitudinal direction. The second unlocking face 13 at an acute angle to the vertical direction.

The middle track 2 is slideably received in the outer track 1. The middle track 2 is slideable relative to the outer track 1 in the longitudinal direction. The middle track 2 includes a sliding groove 21 having first and second lateral walls 24 and 26 spaced from each other in the longitudinal direction. The sliding groove 21 has a width W between the first and second lateral walls 24 and 26. The middle track 2 includes a first side facing the first projection 11 of the outer track 1 and a second side facing the inner track 3. The sliding groove 21 includes rectangular cross sections and extends from the first side of the inner track 2 through the second side of the inner track 2. Each of the first and second lateral walls 24 and 26 of the sliding groove 21 includes a plurality of recesses 22.

The inner track 3 is slideably received in the middle track 2. The inner track 3 is slideable relative to the middle track 2 in the longitudinal direction. The inner track 3 includes a second projection 31. The second projection 31 includes a first unlocking portion 32, a first stop portion 34, a second unlocking portion 33, and a second stop portion 35 arranged in sequence. The first stop portion 34 is located between the first unlocking portion 32 and the second unlocking portion 33 in the longitudinal direction. The second unlocking portion 33 is located between the first stop portion 34 and the second stop portion 35 in the longitudinal direction. The second unlocking portion 33 is at an acute angle to the vertical direction. The second projection 31 can be formed by pressing a side of the inner track 3 to form a recess in the side of the inner track 3 while forming the second projection 31 on the other side of the inner track 3.

The positioning block 4 is slideably received in the sliding groove 21. The positioning block 4 is slideable relative to the middle track 2 in a vertical direction perpendicular to the longitudinal direction. The positioning block 4 includes a first stop end 41 and a second stop end 42 opposite to the first stop end 41. The second stop end 42 is spaced from the first stop end 41 in a thickness direction perpendicular to the longitudinal and vertical directions. The positioning block 4 further includes a stop face 43 extending between the first stop end 41 and the second stop end 42 and extending perpendicular to the longitudinal direction. The stop face 43 faces the first lateral wall 24 of the sliding groove 21. The positioning block 4 further including a guiding face 44 facing away from the stop face 43. In the form shown, the positioning block 4 includes a bottom face extending between the first stop end 41 and the second stop end 42. The bottom face of the positioning block 4 has a bottom hole 46.

According to the form shown, the positioning block 4 further includes a vertical side 49 opposite to the stop face 43 of the positioning block 4 and facing the second lateral wall 26 of the sliding groove 21. The vertical side 49 intersects with the guiding face 44. The stop face 43 of the positioning block 4 includes a guiding section 45 opposite to the guiding face 44. The first stop end 41 of the positioning block 4 includes a first protrusion 47 on each of two sides thereof. The first protrusions 47 respectively extend on the stop face 41 and the vertical face 49. The second stop end 42 of the positioning block 4 includes a plurality of second protrusions 48 on each of two sides thereof. The second protrusions 48 on one of the two sides of the second stop end 42 of the positioning block 4 extend on the stop face 41. The second protrusions 48 on the other side of the second stop end 42 of the positioning block 4 extend on the vertical face 49. The second protrusions 48 of the positioning block 4 are inserted from the first side of the middle track 2 through the recesses 22 of the sliding groove 21 to the second side of the middle track 2. The first lateral wall 24 of the sliding groove 21 is located between the first protrusion 47 and the second protrusions 48 on the stop face 41. The second lateral wall 26 of the sliding groove 21 is located between the first protrusion 47 and the second protrusions 48 on the vertical face 49. Namely, each of the first and second lateral walls 24 and 26 of the sliding groove 21 is located between one of the first protrusions 47 and the second protrusions 48 on one of two sides of the seconds top end 42 of the positioning block 4. Such an arrangement while permits the positioning block 4 to move in the vertical direction and in the longitudinal direction in addition to easy assemblage. The return spring 5 is attached between the positioning block 4 and a wall of the sliding groove 21. The return spring 5 biases the positioning block 4 towards the first projection 11 or the second projection 31. In the form shown, the return spring 5 abuts against an end wall of the bottom hole 46 of the positioning block 4 and a bottom wall of the sliding groove 21 to bias the positioning block 4 upwards.

A spacing L1 between the first stop face 14 and the second stop face 15 of the outer track 1 in the longitudinal direction is in a range of 1.3-2.3 times the width W of the sliding groove 21 to provide slight play in the longitudinal direction. The positioning block 4 is positionable between the first stop face 14 and the second unlocking face 13 of the outer track 1 while permitting the positioning block 4 and the second stop face 15 of the outer track 1 to move towards each other, and the second unlocking face 13 of the outer track 1 can actuate the positioning block 4 to move in the vertical direction.

A spacing L2 between the first stop portion 34 and the second stop portion 35 of the inner track 3 in the longitudinal direction is in a range of 1.3-2.3 times the width W of the sliding groove 21 to provide slight play in the longitudinal direction. The positioning block 4 is positionable between the first stop portion 34 and the second unlocking portion 33 of the inner track 3 while permitting the positioning block 4 and the second stop portion 35 of the inner track 3 to move towards each other, and the second unlocking portion 33 of the inner track 3 can actuate the positioning block 4 to move in the vertical direction.

The first stop end 41 of the positioning block 4 is positionable between the first stop face 14 and the second stop face 15 to position the middle track 1 relative to the outer tack 1 while permitting movement of the positioning block 4 in the vertical direction and having slight play in the longitudinal direction.

With reference to FIGS. 1-5, when the middle track 2 is in a fully retracted position relative to the outer tack 1 and when the inner track 3 is in a fully retracted position relative to the middle track 2, the second stop end 42 of the positioning block 4 is restrained between the first stop portion 34 and the second stop portion 35 of the inner track 3 to position the middle track 2 relative to the inner tack 3 (the middle track 2 and the inner track 3 are in a locking state) while permitting movement of the positioning block 4 in the vertical direction and having slight play in the longitudinal direction. Note that the spacing L2 between the first stop portion 34 and the second stop portion 35 of the inner track 3 in the longitudinal direction is in a range of 1.3-2.3 times the width W of the sliding groove 21 to avoid the positioning block 4 from getting stuck during unlocking and locking procedures. The stop face 43 and the guiding face 44 of the positioning block 4 are respectively positioned at the first stop portion 34 and the second unlocking portion 33 of the inner track 3 while permitting the positioning block 4 and the second stop portion 35 to move relative to each other. The second unlocking portion 33 of the inner track 3 can actuate the positioning block 4 to move in the vertical direction while the positioning block 4 and the second stop portion 35 are moving towards each other, permitting the middle track 2 and the inner track 3 to move out of the outer track 1.

Figure 12:
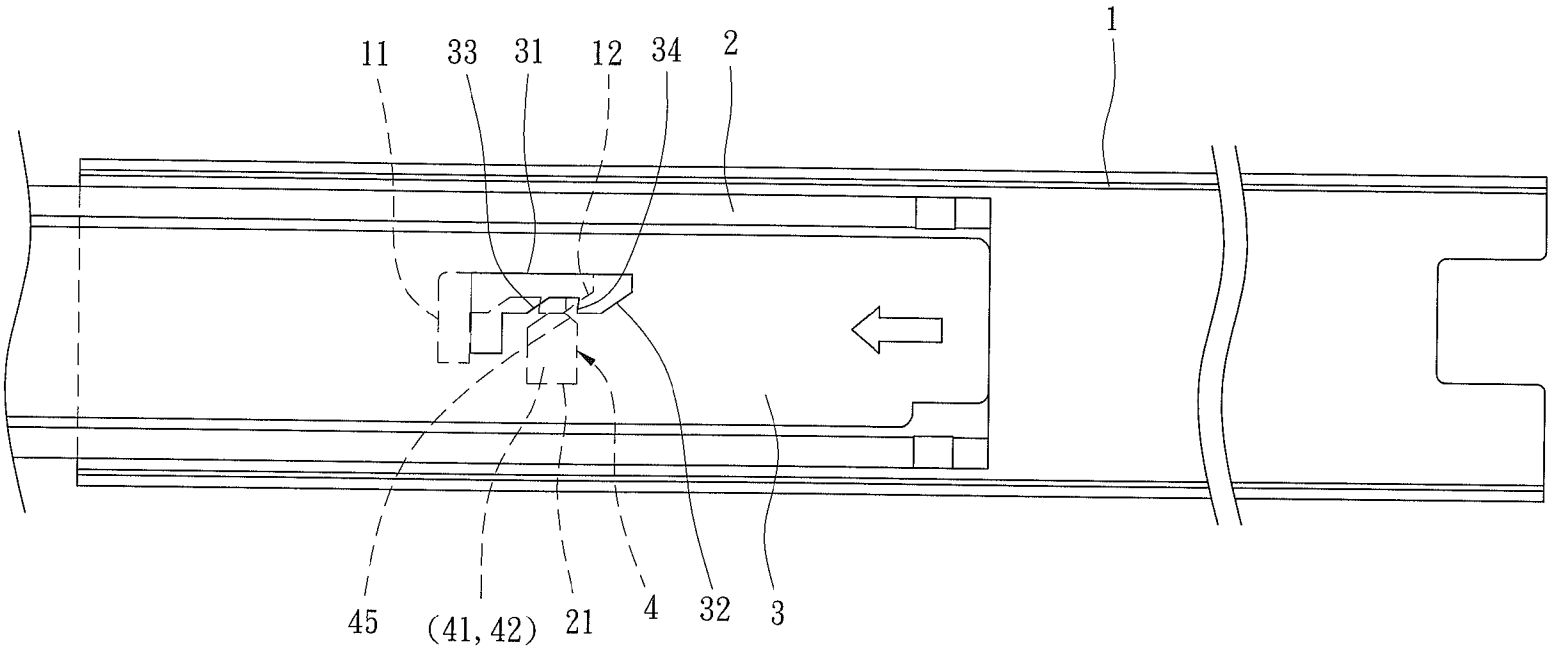
FIG. 12 is view similar to FIG. 11, illustrating downward movement of the positioning block in the sliding groove.
Figure 13:
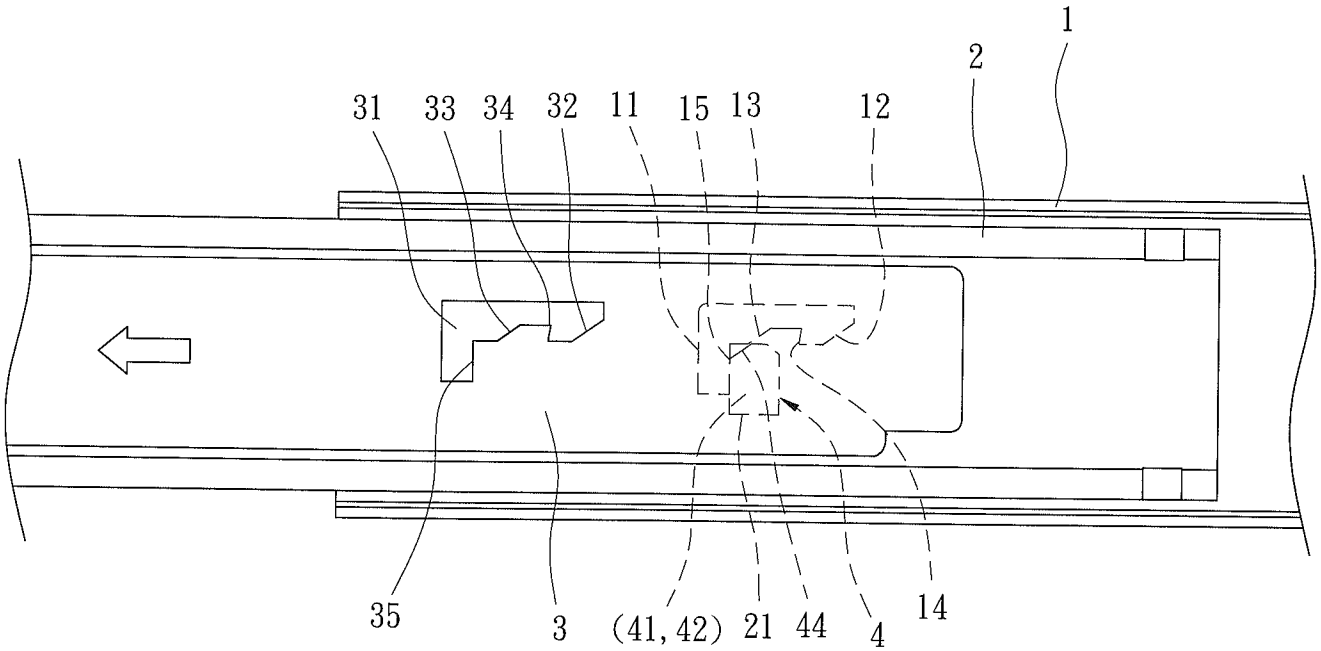
FIG. 13 is a view similar to FIG. 11, illustrating further outward movement of the middle track.
Figure 14:
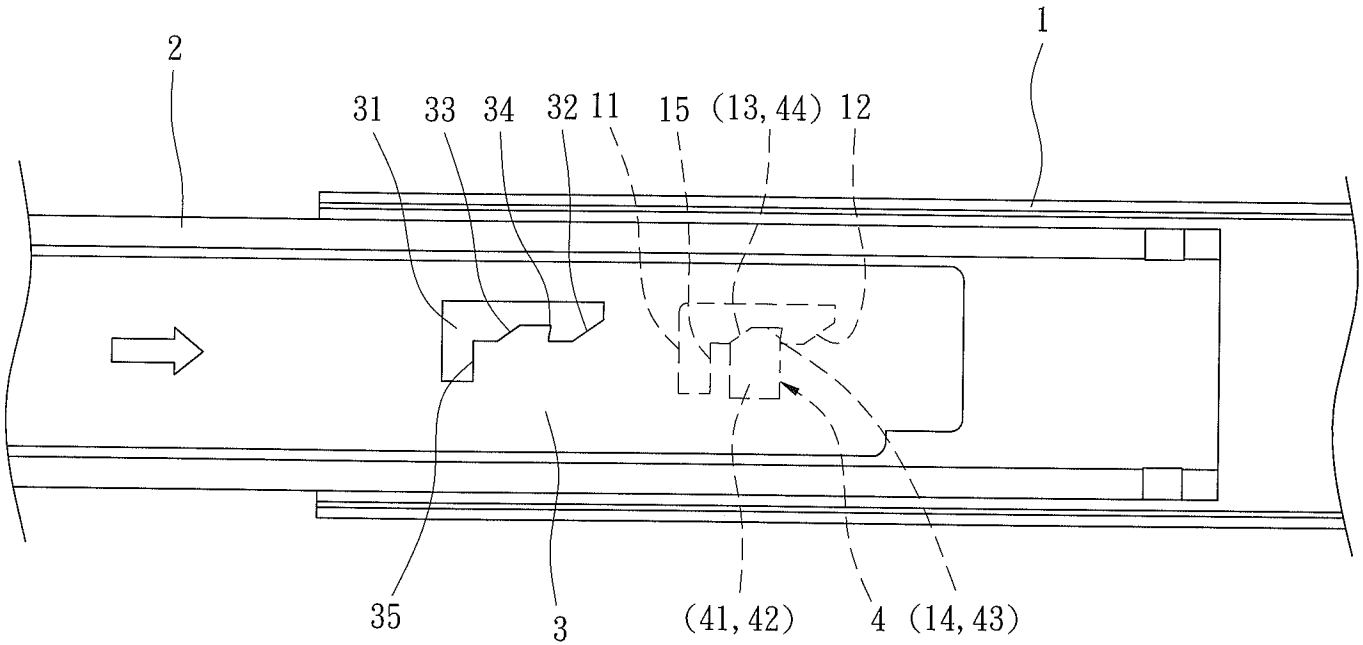
FIG. 14 is a view similar to FIG. 13, with the middle track and the inner track positioned relative to each other.
Figure 15:
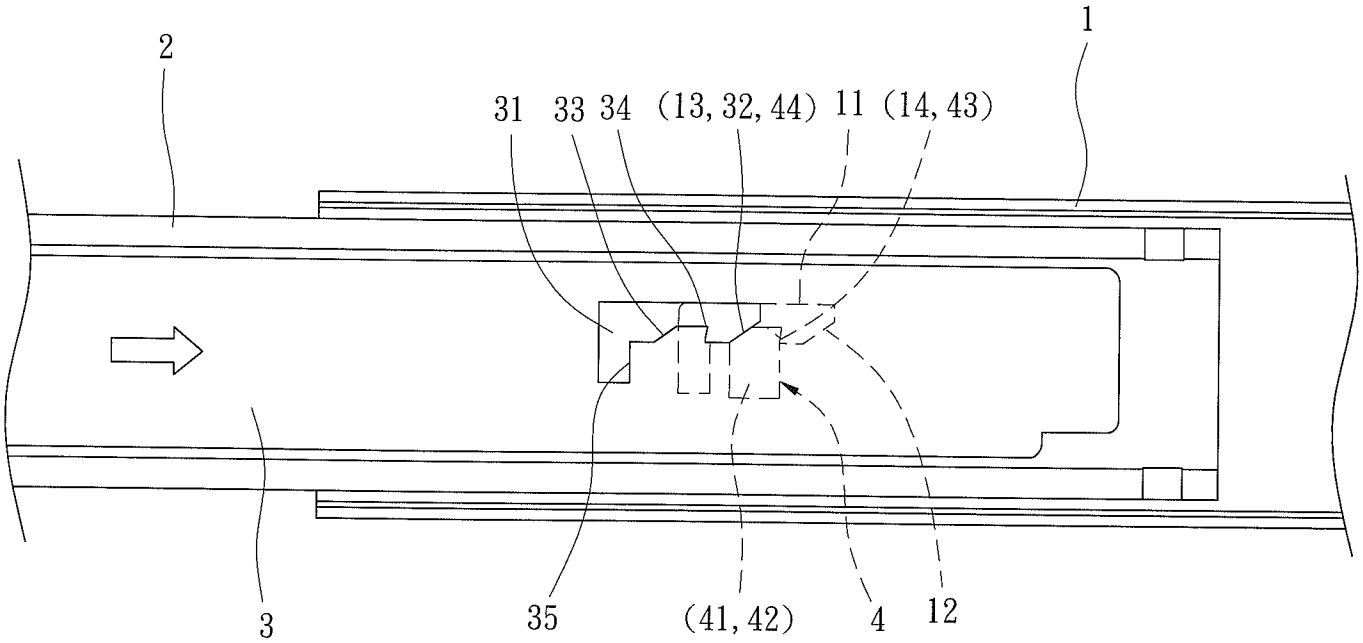
FIG. 15 is a view similar to FIG. 14, illustrating retraction movement of the inner track into the middle track.

With reference to FIGS. 1-3 and FIG. 11, when the inner track 3 is pulled outwards from the fully retracted position, the first stop portion 34 of the inner track 3 presses against the second stop end 42 of the positioning block 4 to jointly move the middle track 2 and the inner track 3 out of the outer track 1. When the positioning block 4 contacts the first projection 11 of the outer track 1 (FIG. 11), the first unlocking face 12 of the first projection 11 presses against the guiding face 44 of first stop end 41 of the positioning block 4 to move the positioning block 4 downwards in the sliding groove 21 of the middle track 2 (FIG. 12). Under the guidance of the guiding section 45 of the second stop end 42 of the positioning block 4, the second stop end 42 of the positioning block 4 disengages from the first stop portion 34 of the inner track 3 to thereby unlock the middle track 2 and the inner track 3. Then, the first stop end 41 of the positioning block 41 passes through the first unlocking face 12 of the outer track 1 to a position restrained between the first stop face 14 and the second stop face 15 of the outer track 1 (see FIG. 13) while permitting vertical movement of the positioning block 4 and having slight play in the longitudinal direction. Specifically, the second unlocking face 13 of the outer track 1 can press against the guiding face 44 of the first stop end 41 of the positioning block 4 to move the positioning block 4 in the sliding groove 21 of the middle track 2, and the positioning block 4 is then biased upwards under the action of the return spring 5 to press against the second unlocking face 13 and the second stop face 15 of the outer track 1. Next, as shown in FIG. 14, the guiding face 44 of the positioning block 4 moves upwards to press against the second unlocking face 13 of the outer track 1, such that the positioning block 4 is restrained between the first stop face 14 and the second unlocking face 13 for positioning the middle track 2 relative to the outer track 1 (the middle track 2 and the outer track 1 are in a locking state). Since the spacing L1 between the first stop face 14 and the second stop face 15 of the outer track 1 in the longitudinal direction is in a range of 1.3-2.3 times the width W of the sliding groove 21 (FIGS. 4 and 6), the positioning block 4 is prevented from getting stuck during the locking and unlocking procedures. Thus, the positioning block 4 is positionable between the first stop face 14 and the second unlocking face 13 of the outer track 1 while permitting the positioning block 4 and the second stop face 15 of the outer track 1 to move towards each other. The second unlocking face 13 of the outer track 1 can actuate the positioning block 4 to move in the vertical direction for unlocking the middle track 2 and the inner track 3 to thereby unlock the middle track 2 and the inner track 3, permitting the inner track 3 to be further pulled out of the middle track 2 to a fully extended position relative to the middle track 2.

Figure 16:
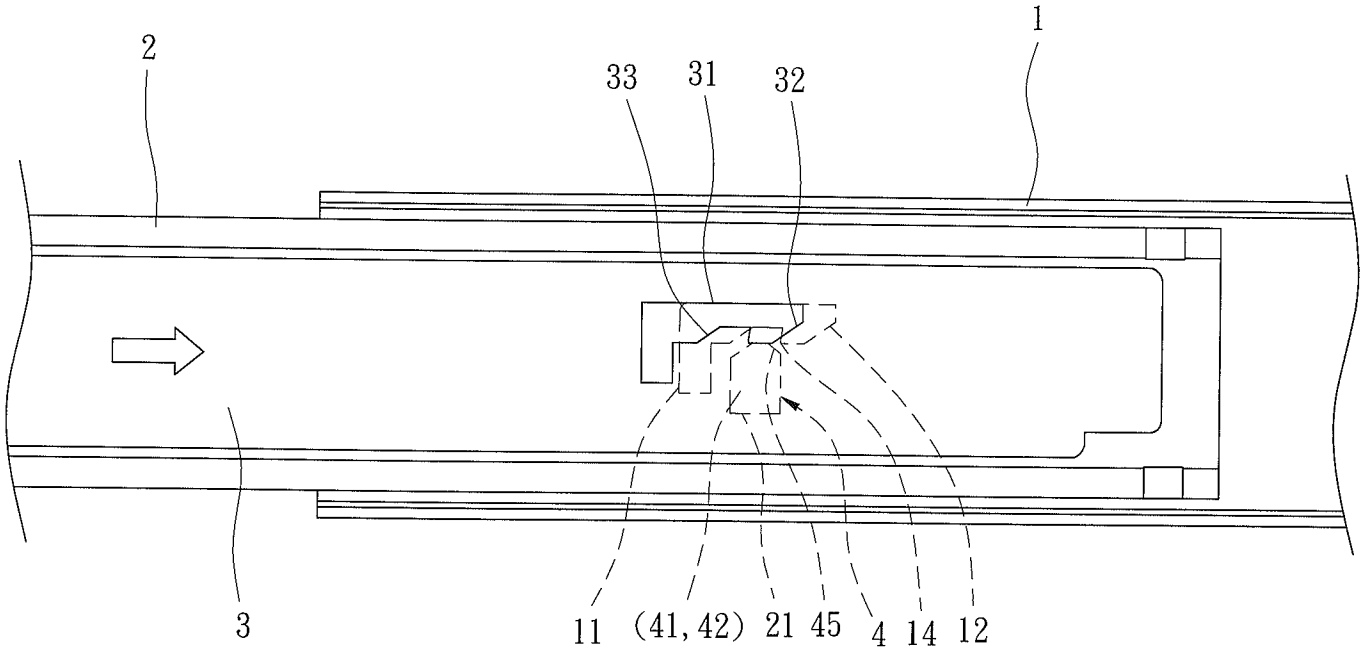
FIG. 16 is a view similar to FIG. 15, illustrating vertical downward movement of the positioning block in the vertical groove.
Figure 17:
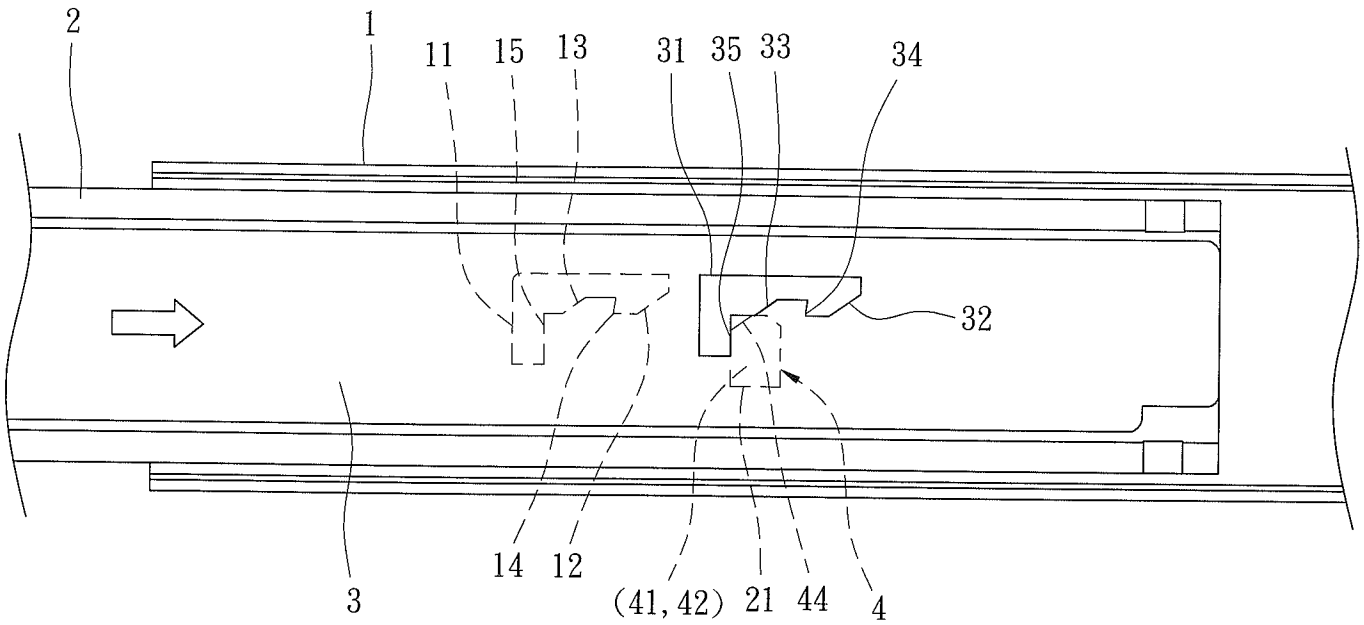
FIG. 17 is a view similar to FIG. 16, with the inner track positioned relative to the outer track.

With reference to FIG. 3 and FIGS. 14-17, when the inner track 3 is moved inwards from an extended position to a retracted position in the middle track 2, the first unlocking portion 32 of the inner track 3 presses against the guiding face 44 of the second stop end 42 (FIG. 15) to move the positioning block 4 downwards in the sliding groove 21 of the middle track 2 in the vertical direction (FIG. 16). Furthermore, the guiding section 45 of the first stop end 41 of the positioning block 4 permits easy disengagement from the first stop face 14 of the outer track 1, such that the second stop end 42 passes through the first unlocking portion 32 of the inner track 3 and is then restrained between the first stop portion 34 and the second stop portion 35 of the inner track 3 (FIG. 17) while permitting movement of the positioning block 4 in the vertical direction and having slight play in the longitudinal direction. Specifically, the second unlocking portion 33 of the inner track 3 can press against the guiding face 44 of the second stop end 42 of the positioning block 4 to move the positioning block 4 downwards in the sliding groove 21 of the middle track 2, and the positioning block 4 is biased upwards under the action of the return spring 5 to press against the second unlocking portion 33 and the second stop portion 35 of the inner track 3. Then, the guiding face 44 of the positioning block 4 presses against the second unlocking portion 33 of the inner track 3, such that the positioning block 4 is positioned between the first stop portion 34 and the second unlocking portion 33 of the inner track 3 while permitting the positioning block 4 and the second stop face 15 to move towards each other. The second unlocking portion 33 actuates the positioning block 4 to move in the vertical direction while the positioning block 4 and the second stop face 15 are moving towards each other to thereby unlock the middle track 2 and the outer track 1, permitting the middle track 2 and the inner track 3 to move jointly to the fully retracted position received in the outer track 1.

In view of the foregoing, the outer track 1, the middle track 2, and the inner track 3 of the slide track assembly according to the present invention permit the middle track 2 and the inner track 3 to be sequentially pulled outwards or to be pushed inwards in a smooth manner. The structural strength and the durability of the slide track assembly are enhanced while permitting easy manufacturing and easy assemblage.

Although specific embodiments have been illustrated and described, numerous modifications and variations are still possible without departing from the scope of the invention. The scope of the invention is limited by the accompanying claims.

The invention claimed is:

1. A slide track assembly comprising:

an outer track including a first projection, with the first projection including a first unlocking face, a first stop face, and a second stop face, and with the first stop face located between the first unlocking face and the second stop face in a longitudinal direction;

a middle track slideably received in the outer track, with the middle track slideable relative to the outer track in the longitudinal direction, with the middle track including a sliding groove having first and second lateral walls spaced from each other in the longitudinal direction;

an inner track slideably received in the middle track, with the inner track slideable relative to the middle track in the longitudinal direction, with the inner track including a second projection, with the second projection including a first unlocking portion, a first stop portion, and a second stop portion, and with the first stop portion located between the first unlocking portion and the second stop portion in the longitudinal direction, a positioning block slideably received in the sliding groove, with the positioning block slideable relative to the middle track in a vertical direction perpendicular to the longitudinal direction, with the positioning block including a first stop end and a second stop end opposite to the first stop end, with the second stop end spaced from the first stop end in a thickness direction perpendicular to the longitudinal and vertical directions, with the positioning block further including a stop face extending between the first stop end and the second stop end, extending perpendicular to the longitudinal direction, and facing the first lateral wall of the sliding groove, with the positioning block further including a guiding face facing away from the stop face; and a return spring attached between the positioning block and a wall of the sliding groove, with the return spring biasing the positioning block towards the first projection or the second projection, with the first stop end of the positioning block positionable between the first stop face and the second stop face to position the middle track relative to the outer tack while permitting movement of the positioning block in the vertical direction and having play in the longitudinal direction, wherein when the inner track is moved inwards from an extended position relative to the middle track to a retracted position in the middle track, the first unlocking portion of the inner track presses against the guiding face of the second stop end to move the positioning block in the sliding groove of the middle track in the vertical direction until the second stop end is restrained between the first stop portion and the second stop portion of the inner track while permitting movement of the positioning block in the vertical direction, and the first stop end of the positioning block is disengaged from the first stop face of the outer track, permitting the middle track and the inner track to move jointly from the fully extended position of the middle track to a retracted position received in the outer track, wherein when the middle track is in a fully retracted position relative to the outer tack and when the inner track is in a fully retracted position relative to the middle track, the second stop end of the positioning block is restrained between the first stop portion and the second stop portion of the inner track to position the middle track relative to the outer tack while permitting movement of the positioning block in the vertical direction, the stop face and the guiding face of the positioning block respectively positioned at the first stop portion and the second unlocking portion of the inner track while permitting the positioning block and the second stop portion to move relative to each other, with the second unlocking portion of the inner track actuating the positioning block to move in the vertical direction while the positioning block and the second stop portion are moving towards each other to unlock the middle track and the outer track, and wherein when the inner track is pulled outwards from the fully retracted position, the first stop portion of the inner track presses against the second stop end of the positioning block to jointly move the middle track and the inner track out of the outer track, wherein when the positioning block contacts the first projection of the outer track, the first unlocking face of the first projection presses against the guiding face of the first stop end of the positioning block to move the positioning block in the sliding groove of the middle track, disengaging the second stop end of the positioning block from the first stop portion of the inner track to thereby unlock the middle track and the inner track, such that the inner track is permitted to be pulled out of the middle track to the fully extended position.

2. The slide track assembly as claimed in claim 1, with the outer track further including a second unlocking face between the first stop face and the second stop face, with the second unlocking face at an acute angle to the vertical direction, with the inner track further including a second unlocking portion between the first stop portion and the second stop portion, and with the second unlocking portion at an acute angle to the vertical direction.

3. The slide track assembly as claimed in claim 1, with the sliding groove having a width between the first and second lateral walls, with a spacing between the first stop face and the second stop face of the outer track in the longitudinal direction being in a range of 1.3-2.3 times the width of the sliding groove, with the positioning block positionable between the first stop face and the second unlocking face of the outer track while permitting the positioning block and the second stop face of the outer track to move towards each other, and with the second unlocking face of the outer track actuating the positioning block to move in the vertical direction while the positioning block and the second stop face of the outer track are moving towards each other, unlocking the middle track and the inner track.

4. The slide track assembly as claimed in claim 1, with the sliding groove having a width between the first and second lateral walls, with a spacing between the first stop portion and the second stop portion of the inner track in the longitudinal direction being in a range of 1.3-2.3 times the width of the sliding groove, with the positioning block positionable between the first stop portion and the second unlocking portion of the inner track while permitting the positioning block and the second stop portion of the inner track to move towards each other, and with the second unlocking portion of the inner track actuating the positioning block to move in the vertical direction while the positioning block and the second stop portion of the inner track are moving towards each other, unlocking the middle track and the outer track.

5. The slide track assembly as claimed in claim 1, with the middle track including a first side facing the first projection of the outer track and a second side facing the second projection of the inner track, with the sliding groove including rectangular cross sections and extending from the first side of the inner track through the second side of the inner track, with each of the first and second lateral walls of the sliding groove including a plurality of recesses, with the positioning block further including a vertical side opposite to the stop face of the positioning block, with the vertical side facing the second lateral wall of the sliding groove and intersecting with the guiding face, with the stop face of the positioning block including a guiding section opposite to the guiding face, with the first stop end of the positioning block including a first protrusion on each of two sides thereof, with the first protrusions respectively extending on the stop face and the vertical face, with the second stop end of the positioning block including a plurality of second protrusions on each of two sides thereof, with the plurality of second protrusions on one of the two sides of the second stop end of the positioning block extending on the stop face, with the plurality of second protrusions on another of the two sides of the second stop end of the positioning block extending on the vertical face, with the plurality of the second protrusions of the positioning block inserted from the first side of the middle track through the plurality of recesses of the sliding groove to the second side of the middle track, and with each of the first and second lateral walls of the sliding groove located between one of the first protrusions and the plurality of second protrusions on one of two sides of the seconds top end of the positioning block while permitting the positioning block to move in the vertical direction and in the longitudinal direction.

6. The slide track assembly as claimed in claim 1, wherein the positioning block including a bottom face extending between the first stop end and the second stop end, with the bottom face having a bottom hole, and with the return spring abutting against an end wall of the bottom hole of the positioning block and a bottom wall of the sliding groove to bias the positioning block upwards.

* * * * *